US008956505B2

(12) United States Patent
Hunt et al.

(10) Patent No.: US 8,956,505 B2
(45) Date of Patent: Feb. 17, 2015

(54) COMPACT FEED SYSTEM AND METHOD FOR COMMINUTED CELLULOSIC MATERIAL

(75) Inventors: Tyson Bradford Hunt, Saratoga Springs, NY (US); Bertil Stromberg, Diamond Point, NY (US)

(73) Assignee: Andritz Technology and Asset Management GmbH, Graz (AT)

( * ) Notice: Subject to any disclaimer, the term of this patent is extended or adjusted under 35 U.S.C. 154(b) by 186 days.

(21) Appl. No.: 12/793,965

(22) Filed: Jun. 4, 2010

(65) Prior Publication Data

US 2010/0314055 A1 Dec. 16, 2010

Related U.S. Application Data

(60) Provisional application No. 61/186,123, filed on Jun. 11, 2009.

(51) Int. Cl.
*D21C 7/00* (2006.01)
*D21C 7/06* (2006.01)

(52) U.S. Cl.
CPC ..... *D21C 7/06* (2013.01)
USPC ..... 162/263; 700/129

(58) Field of Classification Search
USPC ..... 162/198, 263; 700/129
See application file for complete search history.

(56) References Cited

U.S. PATENT DOCUMENTS 4,071,399 A 1/1978 Prough
4,632,729 A * 12/1986 Laakso ..... 162/17
5,622,598 A * 4/1997 Prough ..... 162/52
5,635,025 A * 6/1997 Bilodeau ..... 162/17
5,736,006 A 4/1998 Prough
5,795,438 A 8/1998 Stromberg et al.
5,968,314 A 10/1999 Prough
6,159,336 A * 12/2000 Engstrom et al. ..... 162/17
7,501,043 B2 * 3/2009 Snekkenes et al. ..... 162/70
2001/0022283 A1 * 9/2001 Bilodeau et al. ..... 209/210
2002/0026990 A1 3/2002 Miele et al.
2003/0000660 A1 1/2003 Gustavsson et al.
2004/0060672 A1 * 4/2004 Snekkenes et al. ..... 162/19
2005/0279468 A1 12/2005 Stromberg

FOREIGN PATENT DOCUMENTS

WO 96/17995 6/1996
WO 02/090648 11/2002

* cited by examiner

*Primary Examiner* — Jacob Thomas Minskey
(74) *Attorney, Agent, or Firm* — Nixon & Vanderhye P.C.

(57) ABSTRACT

A feed system for a comminuted cellulosic material including: a chip bin having an upper chip inlet, an interior chamber oriented generally vertically and a lower discharge port; at least one liquor inlet to the chip bin to inject liquor in the chip bin, wherein the chip bin retains sufficient liquor and chips within the interior chamber to create a hydraulic pressure on the chips at the lower discharge port; a generally horizontally oriented chip conveyor or tube coupled to the lower discharge port to receive the chips and liquor from the bin under the hydraulic pressure, wherein the conveyor or tube includes liquor injectors which inject liquor into the chips and the conveyor or tube, and a high pressure transfer device coupled to a discharge of the conveyor or tube to receive the chips and liquor, whereby the hydraulic pressure of the chips and liquor at the discharge of the chip bin is sufficient to feed the chips and liquor to the high pressure transfer device.

19 Claims, 3 Drawing Sheets

COMPACT FEED SYSTEM AND METHOD FOR COMMINUTED CELLULOSIC MATERIAL

RELATED APPLICATION

This application claims the benefit of U.S. Provisional Patent Application Ser. No. 61/186,123, filed on Jun. 11, 2009, the entirety of which is incorporated by reference.

BACKGROUND OF THE INVENTION

The present invention relates to feed systems to deliver comminuted cellulosic fibrous materials, such as wood chips, to a continuous digester treatment vessel and, particularly, relates to feeding these materials to a high pressure transfer device that converts a low pressure slurry of the material to a high pressure slurry of the material that is transported to the digester treatment vessel.

In the pulping of comminuted cellulosic fibrous material (generically referred to herein as "wood chips" or just "chips") in a continuous digester, the wood chips are treated to remove entrapped air and to impregnate the chips with cooking liquor while raising the pressure and temperature of the material to, for example, 150 degrees Celsius (150° C.) and 10 bar gauge (g). Typically, the chips are steamed to purge air and increase the temperature of the chips, impregnated with heated cooking liquor, pressurized and transported as a slurry to the digester.

A conventional chip feeder assembly typically includes a chip bin, a low pressure feeder, a steaming vessel, a vertical chip tube and a high pressure feeder to purge air from, heat and pressurize the chips. Examples of conventional high pressure feeder assemblies are disclosed in U.S. Pat. No. 5,968,314, which shows a chip feeding system for a digester having a vertical chip bin, a horizontal chip steaming vessel, a vertical chip tube (also referred to as a chip chute), and a high pressure feeder.

Conventionally, the chips in the chip bin are relatively dry are slurried with liquor downstream of the chip bin. However, liquor has been added to the chip bin to slurry the chips to facilitate transport of the chips from the chip bin to the steaming vessel and the vertical chip tube.

Steam has also been added to the chips in the chip bin or in a steaming vessel. The chips may also be steamed in a steaming vessel downstream of the chip bin. At the discharge of the steaming vessel or in chip conveyor, liquor has been added to the chips to slurry the chips to facilitate transfer of the chips.

The slurry has been moved by mechanical conveyors, e.g., horizontal tubes with screws and augers, to the vertical chip tube. The screws and augers in the mechanical conveyors are driven by motors that require energy. These moving mechanical components, e.g., screws and augers, are costly in terms of acquisition costs and operating costs. There is a long felt need to reduce acquisition costs, maintenance costs and energy costs in chip feed systems.

The hydraulic pressure of the slurry in the vertical chip tube assists in feeding the chips to the high pressure transfer device. As the chip slurry enters the top of the vertical chip tube, the slurry fills the tube and applies a hydraulic pressure to the chips at the bottom of the tube. The chip tube has a height to ensure that the mass of the chip slurry held in the tube forms a sufficient hydraulic pressure at the bottom discharge end of the tube to feed the chips to the high pressure transfer device, such as a high pressure feeder.

Without sufficient the hydraulic pressure, the suction applied by the high pressure feeder to the incoming chip slurry may form gas bubbles in the slurry entering the feeder.

Once gas becomes entrained in the slurry, the slurry becomes partially compressible and more difficult to pressurize. Gas in the slurry can reduce the efficiency of the high pressure feeder. In some circumstances, gas caused by lack of hydraulic pressure can block the flow of the chip slurry into the high pressure feeder.

Vertical chip tubes have conventionally provided the needed hydraulic pressure to a chip slurry. A vertical chip tube may be 15 feet to 30 feet (5 meters to 10 meters) in height. The height of the chip tube substantially increases the overall height of the chip feed system and requires the chip bin to be at a relatively high elevation above the chip tube. The supporting structures needed for the chip bin and other elevated portions of the chip feed system may be substantial. For example, the chip bin may be at an elevation of 115 feet (35 meters). There is a long felt need to reduce the height of the chip feed system to minimize the structure necessary for the system, and reduce construction and maintenance costs of chip feed systems.

BRIEF DESCRIPTION OF THE INVENTION

A chip feed system has been developed that floods a lower portion of a chip bin with liquor to form a chip slurry in the bin. The slurry in the bin creates hydraulic pressure at the lower discharge of the bin. The hydraulic pressure is sufficient to feed the chip slurry to a high pressure transfer device. Flooding the chip bin can render unnecessary the chip tube.

A chip screw conveyor or chip tube arranged horizontally receives the chip slurry under the hydraulic pressure from the chip bin and feeds the chip slurry to a high pressure transfer device, such as a high pressure pump or high pressure feeder (HPF). Because the hydraulic pressure is created in the chip bin, a chip tube is unnecessary. The chip bin may be positioned at a lower elevation than would be possible if a chip tube were between the bin and the high pressure transfer device.

Flooding the chip bin with liquor creates a slurry of comminuted cellulosic fibrous material in the bin. The hydraulic pressure resulting from the liquor in the bin is sufficient to create the hydraulic pressure needed to feed a high pressure transfer device coupled to a continuous digester. In some cases, the hydraulic pressure formed in the chip bin may eliminate the need for mechanical chip conveyance devices thereby eliminating mechanical actions on the comminuted cellulosic material and eliminating damage from mechanical action on the chip material. Avoiding mechanical chip conveyors may reduce the capital and operating costs of chip transport and improved the physical pulp properties such as better burst strength, tensile strength and tear strength.

A vertical chip tube is not needed because the flooded chip bin applies sufficient hydraulic pressure to feed the chips to a high pressure transfer device. By doing away with a vertical chip tube, the chip feed delivery may be shorter in height than conventional chip feed systems having vertical chip tubes. A shorter chip feed systems require fewer and smaller structural supports that would otherwise be needed to elevate the chip bin to a high elevation and support the chip tube. For example, the chip feed system may have a height of about 6 feet (20 meters). In contrast, a conventional chip feed system with a horizontal chip tube for a similarly sized digester vessel may have a height of 115 feet (35 meters).

Eliminating the chip tube by flooding the chip bin may reduce the height of the chip feed system by, for example, 20 feet (7 m) to 55 feet (17 m). This reduction in the height of the chip feed system provides substantial savings in construction and maintenance costs by reducing the amount of structural steel and other material necessary to provide the high elevation of the chip bin in conventional systems and makes the chip bin more easily accessed by lowering its elevation.

Further, the chip feed system with a flooded chip bin provides a high chip delivery capacity to feed a relatively large chip slurry flow rate to the high pressure feeder or other transport device. By eliminating the chip tube, restrictions on the rate of chip flow through the chip tube are eliminated. The rate of chip slurry flow may be determined by the capacity of the chip bin which is typically a higher capacity than the flow capacity of conventional chip tubes.

In addition, a substantially horizontal chip tube may move the chips by hydraulically moving the chip slurry through and out of the tube. Hydraulic forces are applied by the injection of liquor or steam into the tube. Nozzles for liquor or steam (or both) are arranged along the length of the tube to inject jets of liquor or steam angled towards the direction of chip flow through the tube. Further, jets of liquor or steam at the outlet of the chip tube are optionally applied to force the chip slurry from the tube and into a conduit feeding the high pressure feeder.

The horizontal chip tube may lack moving components such as screws and augers. By reducing or eliminating a need for a screw or auger, the horizontal chip tube has fewer mechanically moving components as compared to horizontal chip tubes with rotating screws and augers.

A feed system is disclosed for a comminuted cellulosic material comprising: a chip bin including an upper chip inlet, an interior chip chamber oriented generally vertically and a lower discharge port; at least one liquor inlet to the chip bin to inject liquor in the chip chamber, wherein the chip bin retains sufficient liquor and chips within the interior chamber to create a hydraulic pressure on the chips at the lower discharge port; a generally horizontally oriented chip conveyor or tube coupled to the lower discharge port to receive the chips and liquor from the bin under the hydraulic pressure, wherein the conveyor or tube includes liquor injectors which inject liquor into the chips in the conveyor or tube, and a high pressure transfer device coupled to a discharge of the conveyor or tube to receive the chips and liquor, whereby the hydraulic pressure of the chips and liquor at the discharge of the chip bin is sufficient to feed the chips and liquor to the high pressure transfer device.

A method is disclosed to feed cellulosic fibrous material to a high pressure transfer device comprising: feeding the cellulosic fibrous material to an upper inlet of a chip bin; adding liquor to the chip bin to at least partially fill the chip bin with a slurry of the liquor and the fibrous material; creating a hydraulic pressure in the slurry at a lower discharge of the chip bin due to the liquor in the chip bin; discharging the slurry under the hydraulic pressure to a substantially horizontal conveyor or tube; injecting liquor into the conveyor or tube to move the slurry to an outlet of the conveyor or tube, and conveying the slurry under the hydraulic pressure from the outlet of the conveyor or tube to an inlet of the high pressure transfer device.

A chip tube comprising: a substantially horizontal tube having an inlet adapted to attach to a discharge outlet of a chip bin and an outlet adapted to be in fluid communication with a chip feeder; a chip slurry passage within the tube extending from the inlet to the outlet; at least one fluid injection nozzle attached to the tube and adapted to inject a fluid into the chip tube, wherein the fluid injection nozzle is at angle to inject the fluid towards a first end of the tube proximate to the outlet.

DETAILED DESCRIPTION OF THE INVENTION

Figure 1:
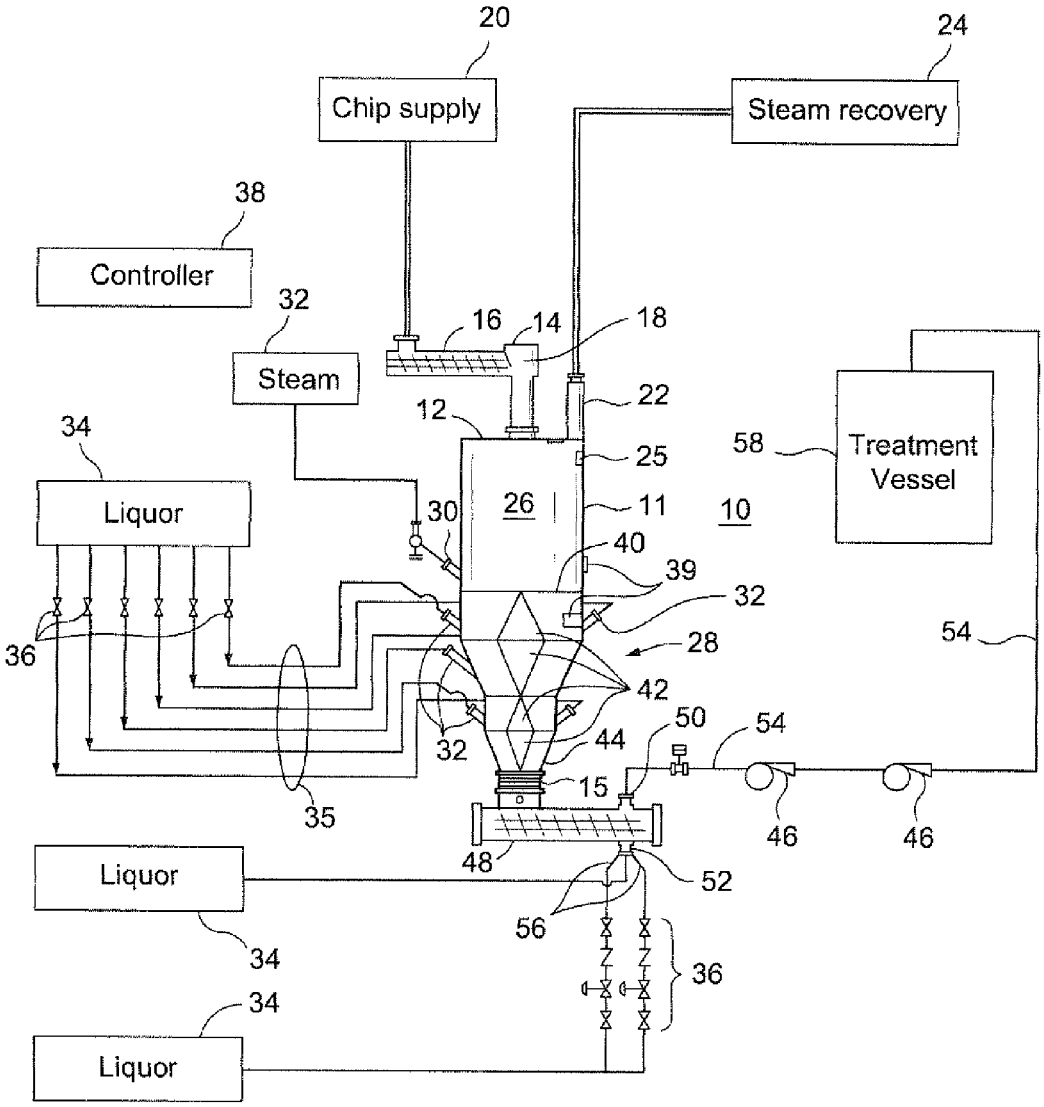
FIG. 1 is a schematic diagram showing a chip bin having a flooded lower bin portion and a bottom outlet, wherein the bin is coupled to a horizontal flooded twin-screw feeder discharging chips directly to a high pressure transfer device.

FIG. 1 shows a chip feed system 10 having a chip bin 11 with a closed top 12 with a conventional top chip inlet 14. The chip bin 11 is a vertical vessel with a bottom discharge 15. The chip inlet 14 may include a metering screw 16 and an air lock 18. The metering screw receives chips via a conduit or conveyor from a chip supply 20. A vent 22 at the top 12 of the chip bin allows steam and other vapors to exhaust from the chip bin to a steam or vapor recovery system 24.

The chip bin 11 may include an upper chamber 26 that has a circular or elliptical cross-section and a diameter of, for example, about 10 to 15 feet (3 to 5 meters). A chip level sensor 25, e.g., a gamma sensor, may be included in the upper chamber to monitor the level and, thus, the amount of chips in the bin. The height of the upper chamber may be one-half to two-thirds the entire height of the chip bin.

Chips from the top chip inlet 14 enter and settle in the upper chamber 26. The chips in the upper chamber form a column of chips that move downward through the chip bin towards a lower chamber 28 of the chip bin. A controller 38, e.g., computer, monitors the chip level sensor 25 and may adjust the chip meter screw 16 to maintain a desired level of chips in the bin.

The chips in the upper chamber 26 may remain relatively dry or be steamed by steam nozzles 30 arranged on the outer wall of the upper section. A steam source 32, e.g., a low pressure steam source, provides steam to the steam nozzles 30 that may be arranged at one or more elevations in the upper chamber of the chip bin. The steam provides heat energy to heat the chips in the upper chamber and to start steaming the chips.

The lower chamber 28 of the chip bin has at an upper end the same cross-section as the lower end of the upper chamber 26. Chips flow directly from the upper chamber to the lower chamber. The lower chamber 28 of the chip bin is entirely or at least partially flooded with liquor. Similarly, a portion of the upper chamber 26 may be flooded with liquor. Liquor injection nozzles 32 are arranged in the lower chamber of the chip bin at, for example, various elevations of the outer wall of the chip bin. At each elevation, an array of liquor nozzles 32 may be distributed around the perimeter of the outer wall of the lower chamber of the chip bin. For example, there may be two elevations of arrays of liquor nozzles 32. The liquor nozzles 32 may be oriented at an angle of between 15 degrees to 85 degrees down from horizontal to inject liquor downward into the chip bin. The downward injection of liquor assists in moving the chops down through the chambers of the chip bin.

A source of liquor 34, e.g., white, green or black liquor, is coupled to each of the liquor nozzles 32 by conduits 35 and valves 36. The valves may be manually adjusted and thereafter remain in a set position to regulate the flow of liquor to the nozzle associated with each valve(s). Alternatively, the valves may be controlled by the computer controller 38 that adjusts the valves to achieve a desired elevation of flooding in the chip bin. A sensor(s) 39, e.g., a float, pressure or optical sensor, may be positioned in the lower chamber of and the upper chamber of the chip bin to monitor the liquor level in the bin.

The geometry, e.g., cross-sectional geometry, of the lower section 28 of the chip bin 11 has a substantially circular cross-section open top 40 and a substantially rectangular cross-section open bottom discharge 15. The lower section 28 has opposite side non-vertical gradually tapering planar side walls 42. The planar side walls 42 make an angle which may be about 20 degrees to 30 degrees. These angles may be set depending upon the particular material handled by the chip bin 11, such as the particular species of wood chips commonly fed to the bin. The lower chamber 28 provides a smooth geometric transition between the circular configuration of the upper chamber 26 and the substantially rectangular bottom discharge 15. Between the opposite planar side walls 42, are opposite curved side walls 44 connected the planar side walls. The planar side walls 42 may each be generally triangular in plan view. These planar sidewalls may be arranged vertically in a diamond shape as shown in FIG. 1.

The sidewalls 42, 44 of the lower section may be welded together and to the upper section to provide a continuous fluid-tight chamber 28 for the chips and liquor in the chip bin. The chamber 28 is generally hollow to promote the uniform movement of chips and liquor down through the chip bin. The chambers 26, 28 in the chip bin and, especially, the lower chamber 28, are shaped to promote a uniform downward movement of chips through the bin across the entire cross-sectional area of the bin. Chip bins that promote a uniform downward flow of chips are disclosed in U.S. Pat. No. 5,617,975 (see col. 6, ln. 65 to col. 8, ln. 52), the entirety of which is incorporated by reference. Further, liquor, chip and steam preferably does not escape from the chip bin except by way of the lower chip slurry discharge 15 and the upper steam and vapor vent 22.

The chip bin is partially flooded with liquor to create a slurry of chips and liquor within the chip bin. The slurry creates an elevated hydraulic pressure at the bottom discharge 15 of the chip bin. The hydraulic pressure is sufficient to force the chip slurry into a high pressure transfer device 46, e.g., a pump(s) or a high pressure feeder without the formation of gases at the inlet of the device 46. The amount of necessary hydraulic pressure is dependent on the requirements of the high pressure transfer device and the components, e.g., screw conveyor in horizontal chip tube 48, between the bin discharge 15 and the high pressure transfer device 46. The hydraulic pressure created by flooding, or at least partially flooding, the chip bin renders a conventional vertical chip tube an unnecessary component to the inlet of the high pressure transfer device 46.

The level, e.g., liquid level, of the slurry in the chip bin may be set to achieve the desired hydraulic pressure. For example, the level of the slurry in the chip bin may be at 15 feet (3 meters) or in a range of 10 feet to 20 feet (3 meters to 7 meters) of elevation from the bottom discharge 15 of the chip bin to the upper surface level of the liquor in the chip bin.

The rate of liquor injected into the chip bin 11, the rate of chips entering the bin and the rate at which the slurry of chips is discharged from the bin determines the level of liquor in the chip bin. Generally, the liquor level in the chip bin should remain at a predetermined level. Liquor level sensors 39 may sense the liquor level in the chip bin. Based on signals from these sensors, the controller 38 may adjust the valves 36 to regulate the flow of liquor through the nozzles 32 and adjust the rates of chips entering and being discharged form the bin to achieve a desired liquor level in the chip bin.

The amount or rate of liquor injected in the chip bin may be in excess of the capacity of the chips to adsorb the liquor during the period that the chips are in the bin. An amount or rate of liquor may be sufficient to generate free liquid in the chip bin. The free liquid is helpful to create a slurry that promotes the discharge flow of chips from the chip bin and move the slurry through the transport device, such as a conveyor 48 or chip tube 62, 82 (FIGS. 2 and 3) without the need for a mechanically acting device.

Liquor 34 for the chip bin may be extracted from the treatment vessel, such as from a top separator device. The amount of liquor needed for cooking or other treatment in the treatment vessel is generally less than the amount of liquor desirable for transporting the liquor as a slurry through the conveyor, chip tube, pumps, high pressure transfer devices and associated conduits (pipes). The liquor in excess of that needed for cooking or treatment may be extracted from the slurry as it enters the treatment vessel such as by using a top separator. The excess liquor may be used black liquor 34 to inject into the chip bin and thereby create a sufficient hydraulic pressure. In addition, white liquor 34 may be injected in the chip bin.

By way of example, the amount of white liquor introduced in the chip bin may be ten (10) percent to fifty (50) percent of the total amount of white liquor introduced in the pulping system generally including the chip bin, chip feed system and treatment vessel(s). All or most of the remainder amount of white liquor is preferably introduced in the treatment vessel(s). The white liquors introduced in the chip bin and in the treatment vessel are used to process, e.g., cook, the chips in the treatment vessel.

For chips formed of heavy, hard woods, the amount of white liquor introduced in the chip bin may be between 10 to 25 percent of the total amount white liquor introduced in the pulping system. For chips formed of softwoods, the amount of white liquor introduced in the chip bin may be between 25 to 50 percent of the total amount of white liquor introduced in the pulping system.

The liquor added to the chip bin may be an initial flood of high concentration white liquor that soaks the chips in the bin. In one example, the wood chip is heavy hard woods that adsorb an amount of liquor 1.2 times the dry weight of wood. Light softwood chip tend to adsorb two times as much liquor as the dry weight of the wood. The amount of liquor, e.g., white liquor, added at the bottom of the chip bin may be at least 0.2 to 1.0 times the dry weight of the wood in the chip bin. For a chip bin having light, softwood chips, the amount of white liquor added to the chip bin may be at least between 0.6 to 1.0 times the dry weight of the chips in the bin. Nevertheless, the amount of liquor in the chip bin is preferably sufficient to create the hydraulic pressure needed to feed the chips into a high pressure feeder.

The white liquor may be added a temperature lower than the temperature of the chips in the chip bin. The lower temperature of the white liquor reduces the risk of premature cooking of the wood chips before the chips are in the treatment vessel. The chips in the chip bin may be heated to 100 degrees Celsius due to the addition of steam 22 to the chip bin. The white liquor may be added a temperatures below 90 degrees Celsius, such as at ambient temperatures.

The chip slurry is discharged under hydraulic pressure from the bottom discharge 15 of the chip bin. The bottom discharge is coupled to a generally horizontal twin-screw conveyor 48 which includes a helical screw in a cylindrical housing. the conveyor 48 may be substantially horizontal, such as at an incline of no more than ten degrees.

The chip slurry enters the screw conveyor 48 and is moved by helical screws to the outlet end 50 of the conveyor. The outlet end has a lower liquor inlet 52 which injects liquor as the chip slurry is discharged through the upper outlet 50 from the screw conveyor to a conduit 54. The injection of liquor to the outlet end 50 of the screw conveyor promotes the discharge of chips into the conduit 54 and assists in avoiding chips plugging and blocking the discharge 50 of the screw conveyor. The injection of liquor may also be used to adjust the ratio of liquor to chips in the slurry to a ratio suitable for the high pressure transfer device.

Nozzles 56 may inject steam or liquor (or both) at the lower inlet 52 to promote the movement of chips out the conveyor. The nozzles 56 may be oriented to apply jets or liquor or steam in a partially upward direction at the chips to assist in moving the chips out of the screw conveyor. The vertical nozzle 56 may be installed by modifying a conventional horizontal chip tube that has an upper chip outlet 78.

The slurry of chips flow through the conduit 54 to the high pressure transfer device(s) 46, such as a series or parallel array of one or more pumps or a high pressure feeder. The high pressure transfer device may be at an elevation substantially the same as, e.g., within 15 to 25 vertical feet (5 to 8 meters), of the elevation of the bottom discharge port 15 of the chip bin. The chip slurry is pressurized in the high pressure transfer device to a pressure level suitable for a treatment vessel 58, such as continuous digester vessel having a top separator inlet to receive the chip slurry from the conduit 54.

Figure 2:
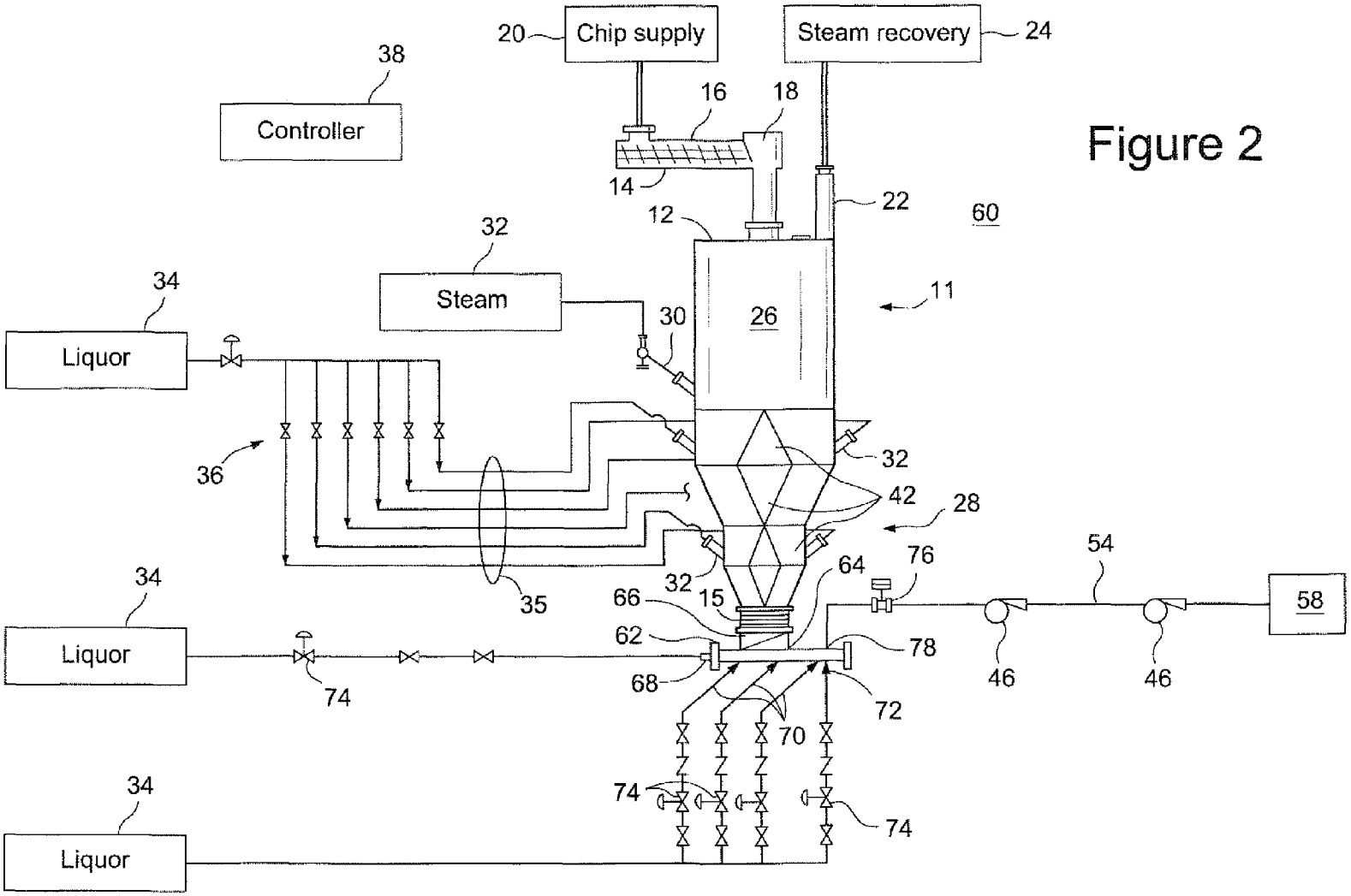
FIG. 2 is a schematic diagram showing a chip bin having a flooded lower bin portion and a bottom outlet, wherein the bin is coupled to a flooded horizontal chip tube feeder discharging chips directly to a high pressure transfer device.

FIG. 2 shows a chip feed system 60 having a flooded chip bin 11 (as shown in FIGS. 1 and 2) and a horizontal chip tube 62 at the bottom discharge 15 of the bin. The chip tube 62 replaces the screw conveyor 48 shown in FIG. 1. The chip bin 11 in the feed system 60 operates in the same manner, and has the same components and geometry as the chip bin 10 described in connection with FIG. 1. In addition, a rotating scraper may or may not be in the bottom of the chip bin to assist in discharging the chip slurry into the chip tube. The rotating scraper is a component of the chip bin and not the chip tube.

The chip tube 62 relies on hydraulic action to move the chip slurry through the tube from the chip bin and to the high pressure transfer device 46. The hydraulic action includes the injection of liquor 34 or steam through nozzles 70 arranged along the casing of the chip tube. By hydraulically moving the chip slurry from the bin to the high pressure feeder, the chip tube avoids mechanical screw and auger devices found in conventional chip conveyors (such as shown in FIG. 1). Cost efficiencies, e.g., acquisition costs, energy costs and maintenance costs, may be achieved by eliminating the screw and auger moving components of a conventional chip conveyor.

The chips are discharged from the bin into the upper inlet 64 of the horizontal chip tube 62. The coupling 66 between the bottom discharge 15 of the chip bin and the upper inlet of the 64 is shaped to promote the smooth and uniform flow of chips into the chip tube. The coupling 66 may have a geometrical cross-sectional shape, such as a circular, elliptical, race track or figure eight.

One or more liquor injectors 68 at the axial end of the chip tube injects liquor 34 or steam into the chip tube 62 to form a flow through the tube that draws chips from the bin and into the tube. Multiple liquor or steam injectors 68 at the axial end and adjacent the coupling 66 to the chip tube may be used to inject liquor or steam into the chip tube to move the chips from the bin and into the chip tube.

The rate of chip flow from the chip bin to the chip tube 62 may be controlled by the amount of liquor or steam injected through injector(s) 68. Similarly, liquor or steam may be injected along the length of the chip tube from nozzles 70 arranged in the sidewall of the chip tube. These nozzles 70 may be oriented to angle the flow of injected liquor in generally the same direction as the desired flow of the chips through the chip tube. These nozzles 70 move the chips through the chip tube and assist in controlling the rate of chip flow through the chip tube. The liquor added from the nozzles 70 may also be used to dilute the chips in the slurry to a chip to slurry ratio suitable for the high pressure transfer device 46 downstream of the chip tube.

A vertically oriented nozzle 72 at the discharge end of the chip tube injects liquor or steam to propel the chips vertically upward from the chip tube and into the conduit 54.

Each of the injectors 68 and nozzles 70, 72 (which may structurally be the same nozzle models) may have a corresponding valve 74 to control the flow of liquor or steam to the injector or nozzle. These valves 74 may be set manually or controlled by the controller 38 based on flow sensor 76 signals in the conduit 54 or at the high pressure transfer device 46.

The chip tube 62 may be a substantially cylindrical tube having an axis and a chip slurry center passage that is substantially fee of obstructions. The casing of the chip tube has mounted thereon the nozzles 70, 72, that are positioned and angled to move the chip slurry through the center passage from the chip inlet to the chip outlet. The nozzles may be mounted at an oblique angle, e.g., 10 degrees to 45 degrees, on the tube casing. The angle of the nozzle orients the fluid stream form the nozzles into the center passage in a direction of chip flow through the passage. The nozzles inject the fluid along an axis of the tube and into a second end of the tube proximate to the inlet. The nozzles may include an axially mounted nozzle proximate to an inlet end of the tube, an array of nozzles at a plurality of nozzle mounts arranged along the casing of the chip tube between the inlet and the outlet, and nozzles adjacent the outlet of the chip tube.

Figure 3:
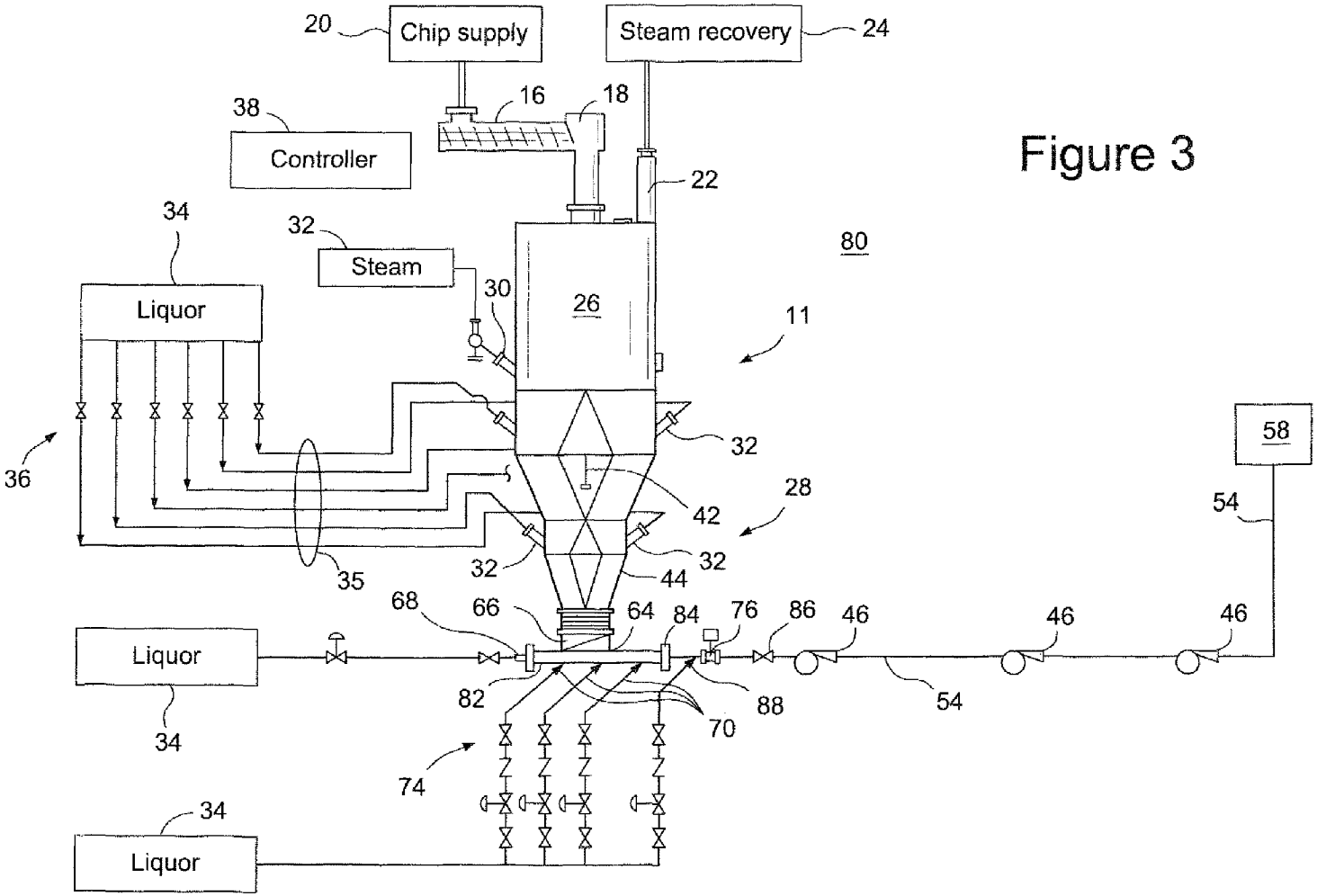
FIG. 3 is a schematic diagram showing a chip bin having a flooded lower bin portion and a bottom outlet, wherein the bin is coupled to a flooded horizontal chip tube feeder discharging chips directly to a high pressure transfer device.

FIG. 3 shows another chip feed system 80 having a flooded chip bin 11 (as shown in FIGS. 1 and 2) and a horizontal chip tube 82 at the bottom discharge 15 of the bin. The chip tube 82 is similar to the chip tube 62 shown in FIG. 3, except that the chip tube 82 has an axial (either in plane or out of plane) chip slurry discharge port 84. The chip slurry discharges from the chip tube to the conduit 54 in substantially the same direction as the chip slurry flow through the chip tube. Because the chip slurry flow is not turned as it exits the chip tube, a vertically oriented liquor nozzle (see FIG. 3 at 72) is not needed at the outlet of the chip tube 84.

The conduit 54 transports the chip slurry to the high pressure transfer device 46. Valves 86 in the conduit may control the flow and pressure of the chip slurry in the conduit. In addition, nozzles 88 with associated valves 74 may inject liquor or steam to assist in moving the slurry through the conduit 54 and to dilute the slurry. The valve 86 and valve 74 for the nozzle(s) 88 may be manually set or controlled by the controller 38 to provide an desired chip slurry flow or pressure in the conduit 54. Further, the conduit 54 may be eliminated and the high pressure transport device, e.g., a pump, may be directly coupled to the outlet 84 of the chip tube 82.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A feed system for a comminuted cellulosic material comprising:

a chip bin including an upper chip inlet, an interior chamber oriented vertically and a lower discharge port, wherein the chip bin includes an upper chamber having a continuously curved cross section, and a lower chamber having a curvilinear cross section and an cross-sectional area decreasing in a downward direction;

a chip metering device configured to convey dry chips provided from a chip supply to the upper chip inlet;

liquor inlets to the chip bin positioned at multiple elevations on the lower chamber of the chip bin and adapted to inject liquor in the lower chamber, wherein the chip bin retains sufficient liquor and chips within the lower chamber to create a hydraulic pressure on the chips at the lower discharge port;

a horizontally oriented chip transport device coupled to the lower discharge port to receive the chips and liquor from the bin under the hydraulic pressure, and a high pressure transfer device having an inlet coupled to a discharge of the chip transport device to receive the chips and liquor directly from the chip transport device, wherein the inlet of the high pressure transfer device is at an elevation equal to or higher than an elevation of the discharge of the chip transport device, and wherein the hydraulic pressure of the chips and liquor at the discharge of the chip bin is sufficient to feed the chips and liquor to the high pressure transfer device, and the hydraulic pressure is equal to or higher than a pressure of the chips and liquor at the inlet of the high pressure transfer device.

2. The feed system of claim 1 wherein the liquor level in the chip bin is at least 15 feet above the lower discharge port of the chip bin, and the chip bin is flooded with liquor and chips between the liquor level and the lower discharge port.

3. The feed system of claim 1 wherein the chip transport device is a horizontal chip tube with liquor injectors which inject liquor into the chips and liquor in the chip tube.

4. The feed system of claim 1 wherein the chip transport device includes a mechanical screw conveyor or auger conveyor.

5. The feed system of claim 1 wherein the chip transport device is a chip tube having liquor nozzles arranged to direct liquor into the chip tube to hydraulically move the chips through the chip tube to the discharge of the chip transport device.

6. The feed system of claim 1 wherein the at least one liquor inlet to the chip bin is an array of liquor nozzles arranged around a perimeter of the chip bin at a plurality of elevations on the chip bin.

7. The feed system of claim 1 wherein the at least one liquor inlet to the chip bin includes a liquor nozzle oriented at an angle of between 15 degrees to 85 degrees down from horizontal to inject liquor downward into the chip bin.

8. The feed system of claim 1 wherein the upper chamber of the chip bin has a circular or elliptical cross section and the lower chamber of the chip bin includes planar tapered opposing sidewalls.

9. The feed system of claim 1 wherein the lower discharge port is at an elevation within 15 feet of an elevation of the high pressure transfer device.

10. A feed system for a comminuted cellulosic material comprising:

a chip bin including an upper chip inlet, an interior chamber oriented vertically and a lower discharge port, wherein the chip bin includes an upper chamber having a continuously curved cross section, and a lower chamber having a curvilinear cross section and an cross-sectional area decreasing in a downward direction;

a chip metering device configured to convey dry chips provided from a chip supply to the upper chip inlet;

at least one liquid liquor inlet to the chip bin adapted to inject liquid liquor in the chip bin, wherein the chip bin retains sufficient liquor and chips within the interior chamber to create a hydraulic pressure on the chips at the lower discharge port;

a liquid liquor level in the chip bin is at least 10 feet above the lower discharge port;

a horizontally oriented chip transport device coupled to the lower discharge port to receive the chips and liquor from the bin under the hydraulic pressure, and a high pressure transfer device including an inlet coupled to a discharge of the chip transport device to receive the chips and liquor, wherein the inlet of the high pressure transfer device is at an elevation equal to or higher than an elevation of the discharge of the chip transport device, and wherein the hydraulic pressure of the chips and liquor at the discharge of the chip bin is sufficient to feed the chips and liquor to the high pressure transfer device, and the hydraulic pressure at the discharge of the chip bin is equivalent to or higher than a pressure of the chips and liquor at the inlet to the high pressure transfer device.

11. The feed system of claim 10 the chip transport device includes a chip tube having liquor nozzles arranged to direct liquor into the chip tube to hydraulically move the chips through the chip tube to the discharge of the chip transport device.

12. The feed system of claim 10 wherein the lower discharge port is at an elevation within 15 feet of an elevation of the high pressure transfer device.

13. A feed system for a comminuted cellulosic material comprising:

a chip bin including an upper chip inlet, an interior chamber oriented vertically and a lower discharge port, wherein the chip bin includes an upper chamber having a continuously curved cross section, and a lower chamber having a curvilinear cross section and an cross-sectional area decreasing in a downward direction;

a chip metering device configured to convey dry chips provided from a chip supply to the upper chip inlet;

liquid liquor inlet arranged at different elevations on the lower chamber of the chip bin and the upper chamber is devoid of liquor inlets, wherein the liquid liquor inlets are adapted to inject liquid liquor into the lower chamber of the chip bin, and wherein the chip bin retains sufficient liquor and chips within the interior chamber to create a hydraulic pressure on the chips at the lower discharge port;

a chip tube having an inlet directly connected to the lower discharge port to receive the chips and liquor from the bin under the hydraulic pressure, wherein the chip tube has a horizontal orientation, and a high pressure transfer device having an inlet connected to the discharge of the chip tube, such that chips and liquor flow directly from the chip tube to the high pressure transfer device;

wherein the inlet to the high pressure transfer device is at the same elevation or higher than an elevation of the discharge of the chip tube, and wherein the hydraulic pressure of the chips and liquor at the discharge of the chip bin is equal to or higher than a pressure of the chips and liquor at the inlet of the high pressure transfer device.

14. The feed system of claim 13 wherein the liquor level in the chip bin is at least 10 feet above the lower discharge port of the chip bin, and the chip bin is flooded with liquor and chips between the liquor level and the lower discharge port.

15. The feed system of claim 13 wherein the chip tube includes liquor injectors which inject liquor into the chips and liquor in the chip transport device.

16. The feed system of claim 13 wherein the chip tube is substantially horizontal.

17. The feed system of claim 13 wherein the chip tube includes a mechanical screw conveyor or auger conveyor.

18. The feed system of claim 13 further comprising liquor nozzles arranged to direct liquor into the chip tube to hydraulically move the chips through the chip tube to the high pressure transfer device.

19. The feed system of claim 13 wherein the lower discharge port is at an elevation within 15 feet of an elevation of the high pressure transfer device.

* * * * *